United States Patent [19]

Häfele

[11] Patent Number: 4,842,496

[45] Date of Patent: Jun. 27, 1989

[54] FUEL INJECTION PUMP FOR INTERNAL COMBUSTION ENGINES INCLUDING ONSET OF SUPPLY CONTROL MEANS

[75] Inventor: Walter Häfele, Fellbach, Fed. Rep. of Germany

[73] Assignee: Robert Bosch GmbH, Stuttgart, Fed. Rep. of Germany

[21] Appl. No.: 687,900

[22] Filed: Dec. 31, 1984

[30] Foreign Application Priority Data

Mar. 14, 1984 [DE] Fed. Rep. of Germany ..... 3409295

[51] Int. Cl.[4] ..... F02M 59/38

[52] U.S. Cl. ..... 417/490; 123/504

[58] Field of Search ..... 417/490, 494, 499; 123/500, 501, 502, 503, 504, 90.16

[56] References Cited

U.S. PATENT DOCUMENTS 2,863,438 12/1958 Challis ..... 123/502
2,997,994 8/1961 Falberg ..... 123/502
4,083,662 4/1978 Höfer et al. ..... 417/499
4,419,977 12/1983 Hillebrand ..... 123/502
4,494,514 1/1985 Augustin ..... 123/502 X

*Primary Examiner*—Leonard E. Smith
*Attorney, Agent, or Firm*—Edwin E. Greigg

[57] ABSTRACT

It is proposed that a drive tappet of a pump piston be provided with an integrated hydraulic supply onset adjusting device. This device includes an adjusting piston, which is guided in a work cylinder and is joined to the piston base of the pump piston, and a pressure chamber. The delivery of the control fluid pumped into the pressure chamber is effected via a delivery conduit discharging into the cylinder bore and a connecting conduit extending inside the pump piston and leading to the pressure chamber. By means of the control point located at the discharge point of the delivery conduit, relatively high control pressures can be fed into the system without relatively large leakage losses. The apparatus is usable in all piston-type supply pumps in which a control face on the pump piston, in cooperation with the control opening in the cylinder bore, determines the onset of supply.

14 Claims, 2 Drawing Sheets

FUEL INJECTION PUMP FOR INTERNAL COMBUSTION ENGINES INCLUDING ONSET OF SUPPLY CONTROL MEANS

BACKGROUND OF THE INVENTION

The invention is based on a fuel injection pump for internal combustion engines defined hereinafter. From U.S. Pat. No. 2,863,438, a fuel injection pump of this type is already known, in which the hydraulic supply onset adjusting device includes, inside the drive tappet, an adjusting piston which is subjected to the pressure of a control fluid source. The control fluid is delivered via a conduit arrangement having a delivery conduit in the pump housing and having, in addition to the delivery conduit discharging into a guide bore of the drive tappet, a radial connecting bore, drilled through the wall of the drive tappet, leading to the pressure chamber of the supply onset adjusting device. At bottom dead center of the pump piston, this connecting bore and the delivery conduit face one another, so that the control fluid, which is under control pressure, can flow into the pressure chamber inside the drive tappet. In this known apparatus, the pressure of the control fluid must overcome the biasing force of the tappet spring exerted upon the adjusting piston. Depending on how great the pressure of the fluid is, the adjusting piston and simultaneously the pump piston are lifted relative to the drive tappet, so that upon the next compression stroke, with the connection between the delivery conduit and the connecting bore having first been broken, an earlier supply onset on the part of the pump piston is brought about than if the pressure of the fluid had not lifted the adjusting piston. The fluid pressure must therefore overcome the biasing force of the tappet spring, which especially in high-speed injection pumps is very great. Accordingly, the pressure must be relatively high, which in turn causes sealing problems and leakage losses. A further disadvantage is that the highly stressed tappet spring inevitably relaxes after a certain period in operation, resulting in altered force ratios, which in turn cause a change in the characteristic of the supply onset adjusting device. The connecting point in the wall of the guide bore between the drive tappet and the pump housing, embodied as a control point, undergoes wear, especially if the pump housing is of aluminum, as is generally the case in in-line injection pumps. This wear is a further cause of leakage losses, and sufficiently severe wear also leads to disruptions in pump function It is accordingly the object of the invention to overcome the above disadvantages and to improve the function of the supply onset adjusting device.

OBJECT AND SUMMARY OF THE INVENTION

In the fuel injection pump according to the invention, the delivery of the control fluid is shifted into a region of the injection pump which is manufactured to extremely high precision and in which parts which slide on one another, that is, the jacket face of the pump piston and the running surface in the cylinder bore, are manufactured of highly wear-resistant steel and fitted in to only a few thousandths of a millimeter. A further advantage is that the orifice of the delivery conduit and the control opening in the wall of the cylinder bore are located on the same structural part, and thus they can be manufactured with great precision in terms of their spaced-apart relationship to one another. The same advantage is attained for the control edges on the pump piston that cooperate with these openings.

Further advantages of the fuel injection pump according to the invention are also attainable. The influence of the tappet spring on the supply onset adjustment can be eliminated entirely, and the characteristic of the control spring controlling the supply onset adjustment can be matched exactly to the required characteristic of the supply onset adjustment. The necessary control pressure can be fixed to a practicable pressure range of approximately 5 to 8 bar. In a further embodiment of the invention, the force of the control spring does not hinder the rotatability of the pump piston. In order to avoid leakage losses at the connecting point between the pump piston and the adjusting piston, the bottom of the pump piston is coupled with the adjusting piston in a sealed manner such as to prevent control fluid from leaking through. If a cup-shaped structural part receiving the work cylinder for the adjusting piston is embodied as a floating cylinder, errors in alignment of the various bores and cylindrical outside diameters of cooperating parts do not have a disadvantageous effect; that is, undesirable lateral pressure forces and a resultant seizing of the pump element can thereby be avoided Further characteristics of the invention include a space-saving structural height of the complete fuel injection pump, despite the elements of the supply onset adjusting device that are additionally built into the drive tappet.

The invention will be better understood and further objects and advantages thereof will become more apparent from the ensuing detailed description of a preferred embodiment taken in conjunction with the drawings, which show a fuel injection pump provided with an integrated hydraulic supply onset adjusting device.

DESCRIPTION OF THE PREFERRED EMBODIMENT

Figure 1:
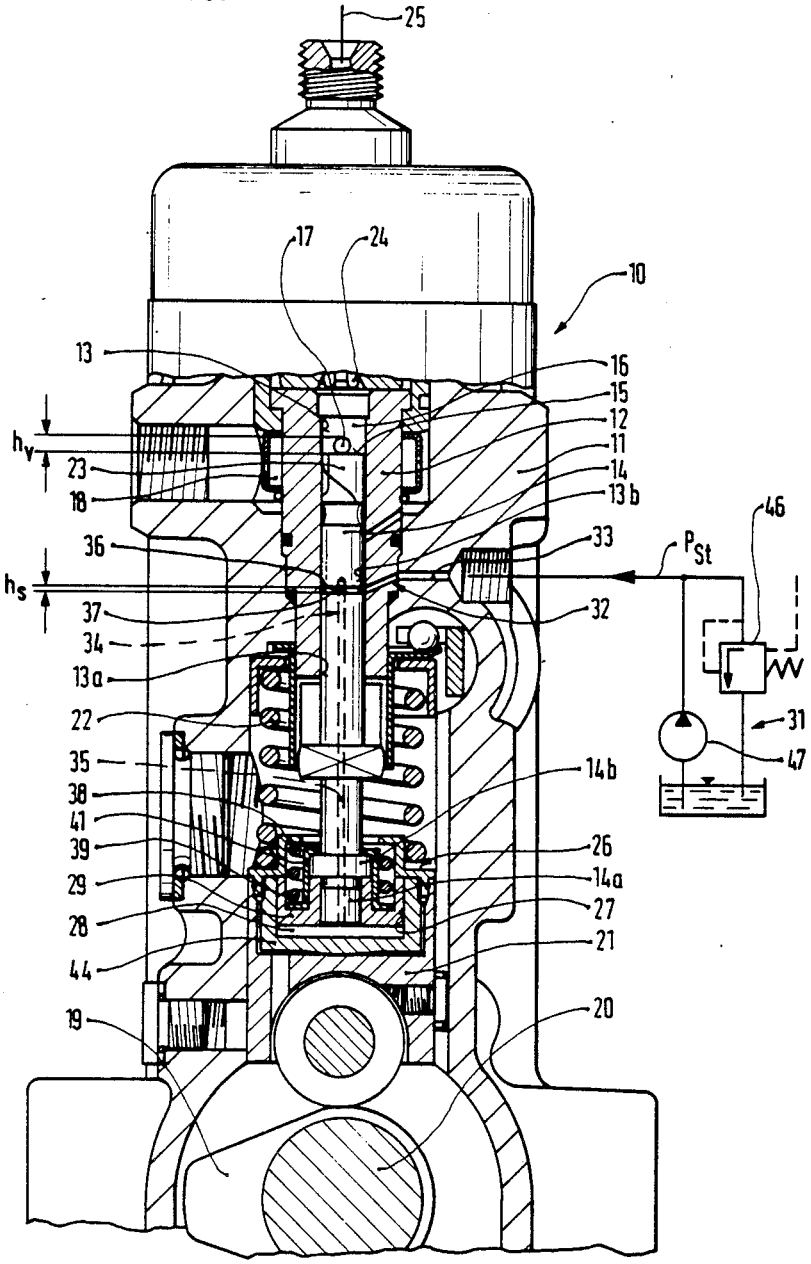
FIG. 1 is a cross section taken through the longitudinal axis of the pump piston, in the vicinity of a pump element of a fuel injection pump shown as a preferred exemplary embodiment and embodied as an in-line pump.

In the fuel injection pump 10 shown in FIG. 1 and embodied as an in-line injection pump, a cylinder bushing 12 is inserted into a pump housing 11, and a pump piston 14 is guided in the cylinder bore 13 of the bushing 12 such that it is axially and rotationally movable. One end face 15 of the pump piston 14 defines a pump work chamber 16 on the drive side, formed at the upper end of the cylinder bore 13, and a control opening 17 penetrating the wall of the cylinder bushing 12 discharges into this chamber 16. In the bottom dead center position of the pump piston 14 shown, this control opening 17 connects a suction chamber 18, which is filled with fuel at pre-supply pump pressure, with the pump work chamber 16 and simultaneously serves as an intake and overflow bore.

The reciprocating movement of the pump piston 14 effecting the pump delivery is transmitted to the pump piston 14 by a drive cam 19 of a camshaft 20 via an interposed drive tappet 21 embodied as a roller tappet. This drive tappet 21 is subjected to the restoring force of a tappet spring 22 and is coupled with a piston base 14*a* of the pump piston. During the upward movement of the pump piston 14, a control face 23 defined on the pump work chamber side by the end face 15 closes the control opening 17, after a pre-stroke $h_v$, and thereby initiates the supply onset. The fuel compressed in the pump work chamber 16 is pumped via a pressure valve 24, shown only in part, and a pressure line 25, shown only in simplified form, to a fuel injection nozzle (not shown) located on the working cylinder of the internal combustion engine.

The drive tappet 21 includes an integrated hydraulic supply onset adjusting device 26, which contains an adjusting piston 29, which supports the piston base 14*a* and is guided in a work cylinder 27 inside the drive tappet 21 and also defines a pressure chamber 28 in the work cylinder 27. To supply the pressure chamber 28 with a control fluid, a control fluid source 31 is connected to the fuel injection pump 10 and delivers hydraulic oil, subjected to control pressure $p_{St}$, to the pressure chamber 28 via a conduit arrangement 32. This conduit arrangement 32 comprises a delivery conduit 33 in the pump housing 11, which continues in the cylinder bushing 12 in the form of an oblique bore and discharges into a section 13*b* of the cylinder bore 13 located between the pump work chamber 16 and an end section 13*a* on the drive side of the cylinder bore 13; during pump delivery, this section 13*b* is continuously covered by the pump piston 14. The conduit arrangement 32 then continues inside the pump piston 14, in the form of a connecting conduit 34 extending inside the pump piston 14 and serving to connect the delivery conduit 33 with the pressure chamber 28 of the supply onset adjusting device 26. This connecting conduit 34 comprises a blind bore 35, extending into the pump piston 14 in the direction of the longitudinal axis of the piston, and at least one transverse bore 36 beginning at the blind bore 35 and discharging into the jacket face of the piston. The discharge opening of this transverse bore 36 comprises an annular groove 37 machined into the jacket face of the pump piston 14, and to improve the flow a second transverse bore may also be provided as needed, at right angles to the transverse bore 36. The annular groove 37 is required if the pump piston 14, as in the illustrated example, can be rotated in order to vary the supply quantity. Alternatively, an annular groove may naturally be machined into the cylinder bore 13 instead.

Figure 2:
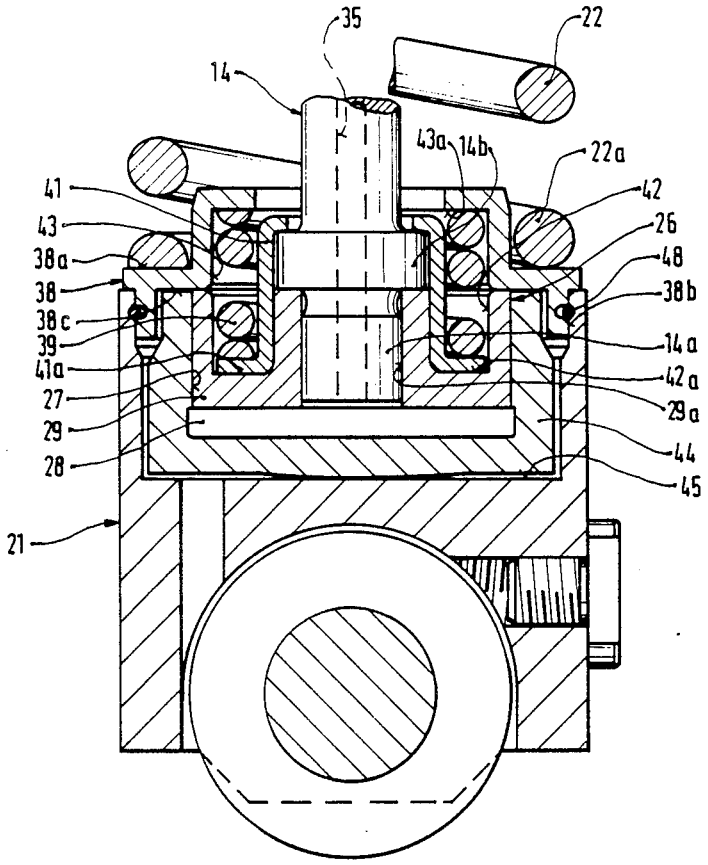
FIG. 2, on a larger scale, shows the associated drive tappet with an integrated hydraulic supply onset adjusting device.

The tappet spring 22 is supported on the drive tappet 21 by means of a tappet spring plate 38 seated on the drive tappet 21, and a control spring 39 counteracting the pressure of the control fluid in the pressure chamber 28 and controlling the adjustment of the supply onset is inserted between the tappet spring plate 38 and the adjusting piston 29. This control spring 39 is supported at one end on the tappet spring plate 38 and at the other on a control spring plate 41 which surrounds the piston base 14*a* and is coupled with the adjusting piston 29. Further structural details of the hydraulic supply onset adjusting device 26 integrated into the drive tappet 21 will be provided below, in conjunction with the description of FIG. 2, showing the apparatus on a larger scale.

The control spring 39 built in with biasing between the tappet spring plate 38 and the control spring plate 41 rests with its end on the drive side on a radially protruding edge 41*a* of the control spring plate 41, which is fabricated as a deep-drawn sheet metal part, and presses the control spring plate 41 against the bottom 42*a* of a depression 42 machined into the adjusting piston 29. With a slight amount of axial and radial play, the control spring plate 41 surrounds a cylindrical collar 14*b* of enlarged diameter at the piston base 14*a* of the pump piston 14. This play is necessary so that the pump piston 14 can be rotated to vary the supply quantity. If the variation in supply quantity is controlled by a reciprocating slide valve, for example, then the pump piston 14 need not be rotated, and then it will have no play with respect to the control spring plate 41. In the direction of the longitudinal axis of the spring and opposite the depression 42, the tappet spring plate 38 also has a depression 43 for receiving the control spring 39. Both depressions 42 and 43 contribute to the fact that despite the additionally built-in control spring 39, the total structural height of the injection pump is increased only to an insignificant extent The section of the connecting conduit 34 serving to deliver the control fluid, which discharges into the pressure chamber 28 of the supply onset adjusting device 26 and is embodied by the blind bore 35, penetrates the piston base 14*a*, which in turn is coupled with the adjusting piston 29 such that it is sealed with respect to any leakage of control fluid, and in the present example it is fitted snugly into a central bore 29*a* of the adjusting piston 29.

The work cylinder 27 surrounding the pressure chamber 28 and receiving the adjusting piston 29 is embodied by a blind bore inside a cup-shaped part 44, which in turn is embodied as a floating cylinder and is inserted with radial play and a slight axial play into a recess 45 on the end of the drive tappet 21. The tappet spring plate 38 covers the recess 45 and keeps the cup-shaped part 44 inside the recess 45. The tappet spring plate 38 has a first step 38*a* (see FIG. 2) on one end, which receives the end 22*a* nearer the tappet of the tappet spring 22, and a second step 38*b* on the other end, which serves to center it in the recess 45 of the drive tappet 21. A bearing face 38*c*, which in the present example is set back, acts as both a positional securing means for the cup-shaped part 44 and a stroke limiting means for the adjusting piston 29.

Although engine lubricating oil is preferably provided as the control fluid, fuel at an appropriate pressure could also be used, which given an appropriately large suction chamber 18 can be drawn directly therefrom and delivered to the delivery conduit 33 or the connecting conduit 34 in the pump piston 14. To generate an rpm-dependent control fluid pressure, which may also be controlled in accordance with further operating parameters if needed, the control fluid source 31 is equipped with a pressure regulating valve 46. The associated supply pump 47, in cooperation with the pressure regulating valve 46, automatically generates an rpm-dependent pressure whenever it is driven by the engine or the injection pump.

The drive tappet 21 may be mounted, and adjusted and tested as well, as a complete unit together with the integrated hydraulic supply onset adjusting device 26. To this end, the tappet spring plate 38 is releasably joined to the drive tappet 21 by means of a snap ring 48 which together with corresponding grooves acts as a loss-preventing means.

To prevent the injection pressure from affecting the position of the adjusting piston 29 established by the control pressure $p_{St}$ and thus from affecting the pre-stroke $h_V$ determining the instant of supply onset, the control points at the control opening 17 and at the orifice of the delivery conduit 33 into the cylinder bore 13 and the spacing between the end face 15 and the annular groove 37 on the pump piston 14 must be adapted to one another such that the pre-stroke $h_V$ is longer than the closing stroke $h_S$. Once the pump piston 14 has executed the closing stroke $h_S$ and the edge of the annular groove 37 toward the drive side has passed the orifice of the delivery conduit 33, the connection between the delivery conduit 33 and the connecting conduit 34 in the pump piston 14 is interrupted. Only after that does the control face 23 close the control opening 17, and pump delivery begins.

The fuel injection pump 10 described in conjunction with FIGS. 1 and 2 and equipped in accordance with the invention with the integrated hydraulic supply onset adjusting device 26 operates as follows:

OPERATION

The effective supply stroke of the pump piston 14 begins whenever the drive tappet 21, and thus the pump piston 14, are raised by the drive cam 19 of the camshaft 20 to such an extent that the control face 23 defined on the side toward the pump work chamber by the end face 15 closes the control opening 17, after the pre-stroke $h_V$. The pre-stroke $h_V$ shown in FIG. 1 is shown there for the earliest possible supply onset, because the adjusting piston 29 has been lifted by the pressure of the control fluid, compressing the control spring 39, and rests on the tappet spring plate 38 serving as a means of stroke limitation.

If the pressure in the pressure chamber 28 has dropped so far that the control spring 39 can displace the adjusting piston 29 into its lower outset position, then what is effected is the latest possible supply onset, with a correspondingly lengthened pre-stroke. At low rpm, this pressure drop may be controlled either automatically or arbitrarily by feeding a corrective adjusting variable at the pressure regulating valve 46. At a pressure chamber in the pressure chamber 38 that is between the lower control pressure determined by the biasing force of the control spring 39 and an upper control pressure fixed by the adjusting stroke of the adjusting piston 29, a corresponding intermediate position of the adjusting piston 29 and a resultant pre-stroke $h_V$ varied thereby are effected. If lesser demands are made on the adjusting characteristic, it may also suffice to realize only a so-called on or off circuit, in which an appropriately high control pressure is merely put into or out of action, optionally via a magnetic valve.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines comprising a pump housing, a bushing in said pump housing, a cylinder bore in said pump housing and said bushing, at least one pump piston guided inside said cylinder bore and defining a pump work chamber;

a fuel inlet opening in said housing and said bushing that discharges into said cylinder bore, a control face on the pump piston which after a pre-stroke ($h_V$), closes said opening discharging into said cylinder bore thereby controlling supply onset;

a drive tappet subjected to the restoring force of a tappet spring coupled with a piston base of the pump piston;

a hydraulic supply onset adjusting device integrated into the drive tappet said device arranged to contain an adjusting piston supporting the piston base and guided in a work cylinder inside the tappet having an end portion and defining a pressure chamber in the work cylinder;

a control fluid source, a delivery conduit in said housing connected to said control fluid source, a connecting conduit in said bushing arranged to establish a connection between said control fluid source and the pressure chamber in said work cylinder, when the pump piston is at bottom dead center said conduit communicates with said delivery conduit in said pump housing;

the delivery conduit in said housing and said conduit in said bushing arranged to discharge into a section of the cylinder bore located between the pump work chamber and an end section of said bushing with said section of the cylinder bore continuously covered by the pump piston during pump delivery;

and a connecting conduit which extends inside said pump piston and thereby serves to connect the delivery conduit in said pump housing and said conduit in said bushing with the pressure chamber of the supply onset adjusting device.

2. A fuel injection pump as defined by claim 1, further wherein the connecting conduit further comprises a blind bore which extends from the pressure chamber into the pump piston in the direction of a longitudinal piston axis and at least one transverse bore beginning at the blind bore and arranged to discharge into a jacket face of the pump piston.

3. A fuel injection pump as defined by claim 2, further wherein at least one transverse bore is connected to an annular groove located in the jacket face of the pump piston.

4. A fuel injection pump as defined by claim 2, further wherein the connecting conduit which discharges into the pressure chamber of the supply onset adjusting device penetrates the piston base of the pump piston, and further that the piston base is coupled with the adjusting piston in a sealed manner which prevents leakage of control fluid.

5. A fuel injection pump as defined by claim 3, further wherein the connecting conduit which discharges into the pressure chamber of the supply onset adjusting device penetrates the piston base of the pump piston, and further that the piston base is coupled with the adjusting piston in a sealed manner which prevents leakage of control fluid.

6. A fuel injection pump for internal combustion engines comprising a pump housing, a bushing in said pump housing, a cylinder bore in said pump housing and said bushing, at least one pump piston guided inside said cylinder bore and defining a pump work chamber;

a fuel inlet opening in said housing and said bushing that discharges into said cylinder bore, a control face on the pump piston which after a pre-stroke ($h_V$), closes said opening discharging into said cylinder bore thereby controlling supply onset;

a drive tappet subjected to the restoring force of a tappet spring coupled with a piston base of the pump piston;

said tappet spring is supported on the drive tappet by means of a tappet spring plate seated thereon;

a hydraulic supply onset adjusting device integrated into the drive tappet, said device arranged to contain an adjusting piston supporting the piston base and guided in a work cylinder inside the drive tappet having an end portion and defining a pressure chamber in the work cylinder;

a control spring inserted between the tappet spring plate and the adjusting piston which counteracts a control pressure ($p_{St}$) of the control fluid in the pressure chamber and also controls the supply onset adjustment;

a control fluid source;

a delivery conduit in said housing connected to said control fluid source;

a connecting conduit in said bushing arranged to establish a connection between said control fluid source and the pressure chamber in said work cylinder, when the pump piston is at bottom dead center said conduit communicates with said delivery conduit in said pump housing;

the delivery conduit in said housing and said conduit in said bushing arranged to discharge into a section of the cylinder bore located between the pump work chamber and an end section of said bushing with said section of the cylinder bore continuously covered by the pump piston during pump delivery;

and a connecting conduit which extends inside said pump piston and thereby serves to connect the delivery conduit in said pump housing and said conduit in said bushing with the pressure chamber of the supply onset adjusting device.

7. A fuel injection pump as defined by claim 6, further wherein the tappet spring plate is joined to the drive tappet by means of a loss-prevention means, comprising a snap ring.

8. A fuel injection pump as defined by claim 6, further wherein the control spring is supported at one end on the tappet spring plate and at the other on a radially protruding edge of a control spring plate which surrounds the piston base with slight play and thereby couples it with the adjusting piston.

9. A fuel injection pump as defined by claim 8, further wherein the tappet spring plate is joined to the drive tappet by means of a loss-prevention means, comprising a snap ring.

10. A fuel injection pump for internal combustion engines comprising a pump housing, a bushing in said pump housing, a cylinder bore in said pump housing and said bushing, at least one pump piston guided inside said cylinder bore and defining a pump work chamber;

a fuel inlet opening in said housing and said bushing that discharges into said cylinder bore, a control face on the pump piston which after a prestroke ($h_V$), closes said opening discharging into said cylinder bore thereby controlling supply onset;

a drive tappet subjected to the restoring force of a tappet spring coupled with a piston base of the pump piston;

a hydraulic supply onset adjusting device integrated into the drive tappet, said device arranged to contain an adjusting piston supporting the piston base and guided in a work cylinder inside the drive tappet having an end portion and defining a pressure chamber in the work cylinder;

said work cylinder surrounds the pressure chamber, is arranged to receive the adjusting piston and is embodied by a blind bore inside a cup-shaped part embodied as a floating cylinder, said floating cylinder being inserted with radial and axial play into a recess on the end portion of the drive tappet and held therein by a tappet spring plate which transmits the restoring force of the tappet spring to the drive tappet;

a control fluid source;

a delivery conduit in said housing connected to said control fluid source;

a connecting conduit in said bushing arranged to establish a connection between said control fluid source and the pressure chamber in said work cylinder, when the pump piston is at bottom dead center said conduit communicates with said delivery conduit in said pump housing;

said connecting conduit further comprises a blind bore which extends from the pressure chamber into the pump piston in the direction of a longitudinal piston axis and at least one transverse bore beginning at the blind bore and arranged to discharge into a jacket face of the pump piston;

said connecting conduit further penetrates the piston base of the pump piston and the piston base is coupled with the adjusting piston in a sealed manner which prevents leakage of control fluid;

the delivery conduit in said housing and said conduit in said bushing arranged to discharge into a section of the cylinder bore located between the pump work chamber and an end section of said bushing with said section of the cylinder bore continuously covered by the pump piston during pump delivery;

and a connecting conduit which extends inside said pump piston and thereby serves to connect the delivery conduit in said pump housing and said conduit in said bushing with the pressure chamber of the supply onset adjusting device.

11. A fuel injection pump as defined by claim 10, further wherein the tappet spring plate further includes a first step arranged to receive an end of the tappet spring and a second step which serves to center the tappet spring plate in the recess of the drive tappet, as well as to provide a bearing face which acts both as a positional securing means for the cup-shaped part and as a stroke limitation for the adjusting piston.

12. A fuel injection pump as defined by claim 11, further wherein the adjusting piston and the tappet spring plate each have means defining a depression with the means defining a depression arranged to receive a control spring which counteracts the control pressure ($p_{St}$) of the control fluid in the pressure chamber.

13. A fuel injection pump as defined by claim 10, further wherein the adjusting piston and the tappet spring plate each have means defining a depression with the means defining a depression arranged to receive a control spring which counteracts the control pressure ($p_{St}$) of the control fluid in the pressure chamber.

14. A fuel injection pump as defined by claim 13, further wherein the control spring is supported between the tappet spring plate and a radially protruding edge of a control spring plate which surrounds the piston base with a slight play and thereby couples it with the adjusting piston.

* * * * *